United States Patent [19]

Rawlings

[11] Patent Number: 4,694,546

[45] Date of Patent: Sep. 22, 1987

[54] APPARATUS FOR STRIPPING PAINT

[75] Inventor: Kirk A. Rawlings, Wausau, Wis.

[73] Assignee: Wausau Metals Corporation, Wausau, Wis.

[21] Appl. No.: 804,781

[22] Filed: Dec. 5, 1985

[51] Int. Cl.[4] ..... B21C 43/00

[52] U.S. Cl. ..... 29/81 D; 29/81 R; 29/90 R

[58] Field of Search ..... 29/81 D, 81 R, 90 R, 29/90.3

[56] References Cited

U.S. PATENT DOCUMENTS

| | | | |
|---|---|---|---|
| 1,408,735 | 3/1922 | Heisler | 29/81 D |
| 1,657,779 | 1/1928 | Bly | 29/81 D |
| 2,044,561 | 6/1936 | Bidle | 29/81 D |
| 2,561,101 | 7/1951 | Dewey | 29/81 D |
| 2,575,816 | 11/1951 | Johnson | 29/81 D |
| 2,724,137 | 11/1955 | Beals | 29/81 D |
| 4,605,073 | 8/1986 | Nilsson et al. | 29/81 D |

FOREIGN PATENT DOCUMENTS

| | | | |
|---|---|---|---|
| 323283 | 1/1930 | United Kingdom | 29/81 D |

*Primary Examiner*—Howard N. Goldberg
*Assistant Examiner*—Irene Graves Golabi
*Attorney, Agent, or Firm*—Andrus, Sceales, Starke & Sawall

[57] ABSTRACT

An apparatus is disclosed for stripping paint which includes a plurality of rapidly reciprocating needle chisels to strike paint off an article and a pair of brush-polishers to polish the surface of the article so that subsequent paint layers do not adhere to it as well. The method of use of this apparatus also involves first cryogenically cooling the article to loosen the bond of the paint thereon.

10 Claims, 3 Drawing Figures

APPARATUS FOR STRIPPING PAINT

TECHNICAL FIELD

This invention relates to stripping paint from coated objects and more particularly to mechanically removing paint from a paint-coated object which has first been subjected to cryogenic cooling.

BACKGROUND OF THE INVENTION

Paint manufacturers normally formulate coatings to firmly adhere to the surface of objects to which the paint is applied. Understandably, as paint formulators have become more successful in developing durable paints, the efficient removal of those paints has become a more burdensome task. Traditionally, scraping, burning and dissolving have been used with varying degrees of success to remove paint. Where the paint strongly adheres to the object surface, scraping requires forceful direct contact with the entire surface of the coated object. Indeed, several scraping passes may be necessary to completely remove paint from a surface, and the object itself may become undesirably worn, scarred or damaged during the scraping process. Burning, of course, is limited to cases where the object is itself not combustible, and generally requires a substantial investment of time to isolate the object in a combustion chamber, to heat the object sufficiently to oxidize the paint, and to cool the object for removal from the chamber. Moreover, fuel use may be substantial, and some coatings may even leave a residue on the object surface. Solvent treatment often requires costly and hazardous chemicals which must be disposed of or reclaimed after use. Care must also be taken to remove residual solvent from the treated object.

A less traditional method of removing coatings involves substantial cooling of the coated object. The difference between the expansion coefficients of the coating material and the underlying object causes a stress during cooling which reduces the adhesion of the paint to the object. Some paints become brittle and crack. An early use of cooling during the removal of a paraffin coating for motion film is disclosed in U.S. Pat. No. 2,854,360 to Pajes.

As refrigerants such as dry ice, liquified air and liquid nitrogen have become more affordable and available, their use in various commercial operations has expanded. For example, U.S. Pat. No. 3,741,804 to Stapleton describes immersion of machine parts in liquid nitrogen so that a protective layer of ice may later be formed thereon by condensation from a moist environment. Surface removal by spraying with solid dry ice particles is described in U.S. Pat. No. 3,702,519 to Rice et al. Cooling has also been used in such diverse processes as conditioning leather goods (see U.S. Pat. No. 3,130,083 to Turner) and cleaning dishes (see U.S. Pat. No. 3,419,427 to Plock).

Precooling has been used to embrittle surface layers to facilitate their removal. U.S. Pat. No. 3,527,414 to Schorsch shows a process for striking insulation from wire by enbrittling the insulation and thereafter grinding the wire until the insulation is fragmented and removed. U.S. Pat. No. 4,312,156 to McWhorter describes a housing in which articles may be cryogenically cooled and then subjected to shot blasting under cryogenic conditions for surface alteration. A somewhat similar process is described in U.S. Pat. No. 3,934,379 to Braton et al. for removing organic coatings from articles. These operations must be carried out in a cryogenic environment and thus require fairly sophisticated machinery including refrigerated chambers.

In addition to the grinding and blasting shown in the art presented above, processes have used various impact or stress devices for coating removal, such as pressing and cooling (see U.S. Pat. No. 3,845,895 to Nakahara), scoring and breaking (U.S. Pat. No. 4,371,103 to Siemens et al.), plunger striking (U.S. Pat. No. 628,069 to Brown), high-speed needle puncture (U.S. Pat. No. 3,490,664 to Boultinghouse), and hammer striking (U.S. Pat. No. 543,771 to Kennedy). A more modern impact method uses a hand-held pneumatic needle scaler which reciprocates a cluster of chisel needles. As the chisel needles reciprocate, the user presses the chisel needle ends against a surface of an article to descale, strip, or clean that surface. The needles are sufficiently flexible to conform to and scrape a wide variety of surface conformations. Nevertheless, the surface treatment can be time-consuming when the scale, paint, or dirt adheres tightly to the surface of the object.

SUMMARY OF THE INVENTION

The present invention is summarized in that an apparatus for stripping paint includes an elongated frame; means for conveying articles along within the frame; a horizontal platen located centrally in the frame and positioned so that the articles are conveyed across it; and a plurality of reciprocating needle chisels positioned above the platen for striking the article as it is conveyed across the platen to remove any paint therefrom.

The present invention also envisions a method for stripping paint wherein the article is first cryogenically cooled then conveyed through the apparatus of the present invention.

It is an object of the present invention to provide an apparatus for rapidly, easily, and efficiently removing paint from articles such as conveyor hangers, which are repetitively painted, stripped, and re-painted.

It is a feature of the present invention that the apparatus, in addition to removing the paint from the article, also brushes and polishes the surface of the stripped article so that subsequently applied paint coating are easier to remove.

Other objects, advantages and features of the present invention will become apparent from the following specification when taken in conjunction with the accompanying drawings.

DESCRIPTION OF THE PREFERRED EMBODIMENT

Figure 1:
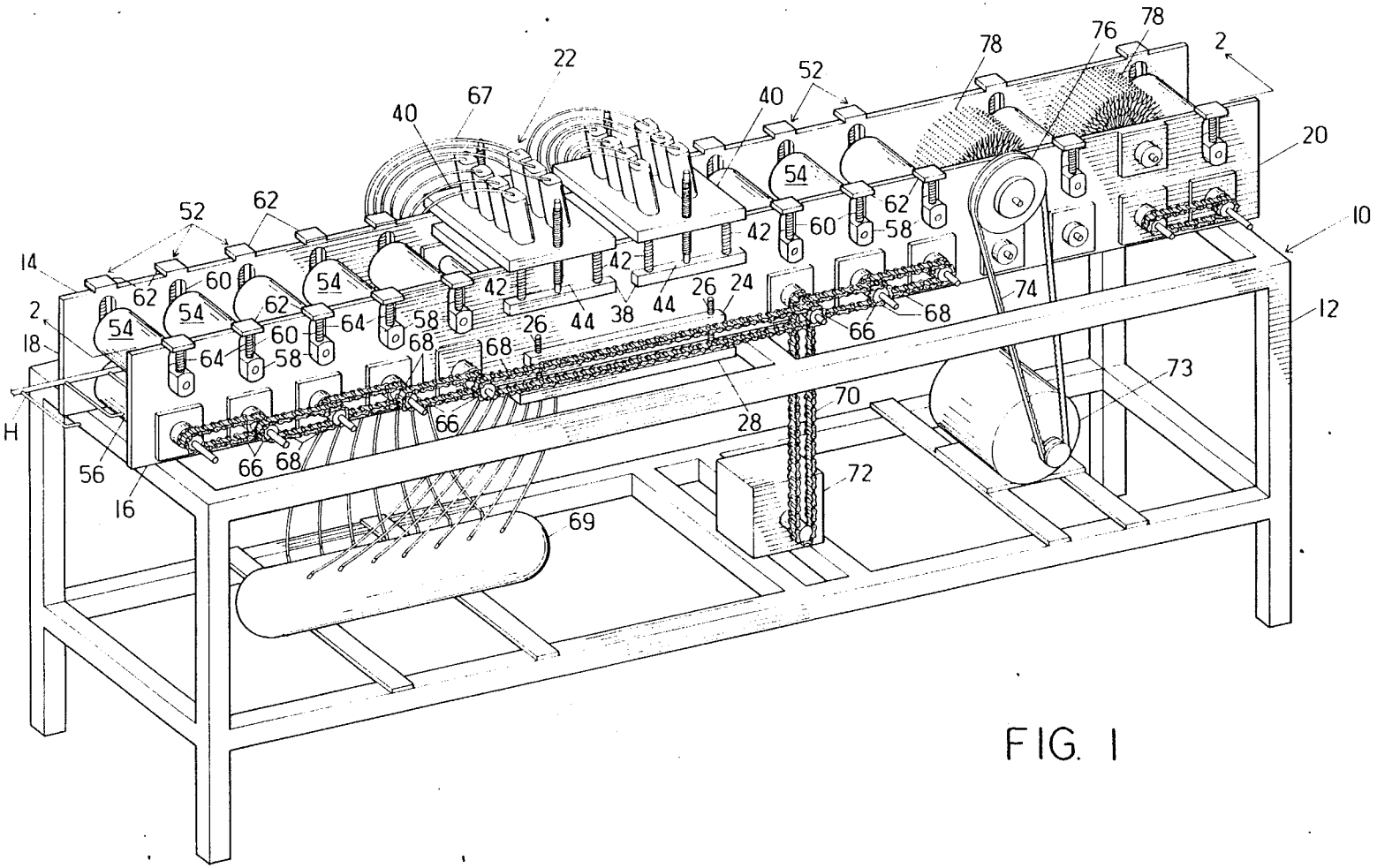
FIG. 1 is a perspective view of the apparatus of the present invention.
Figure 2A:
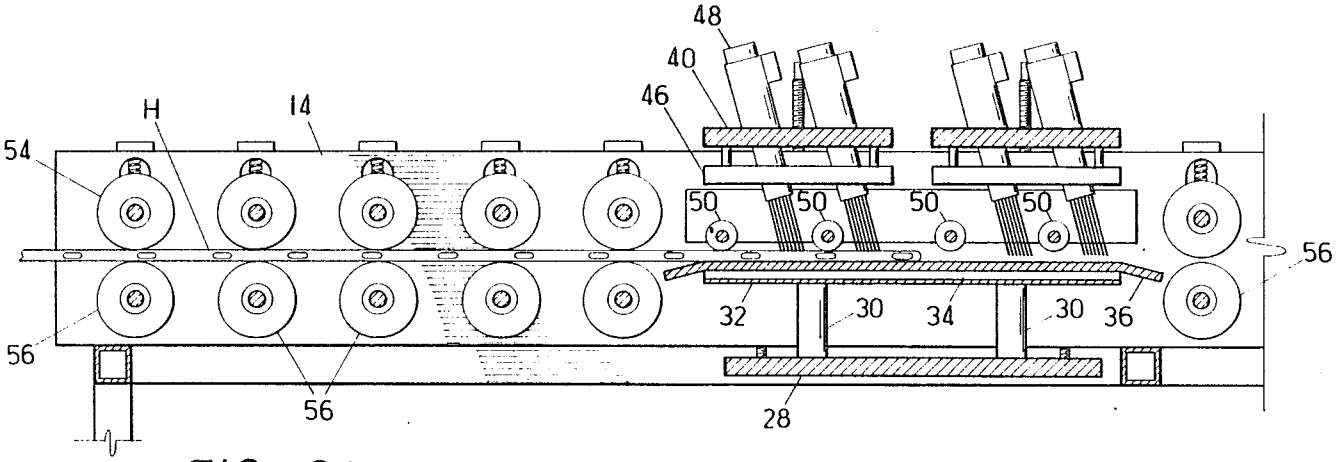
FIGS. 2A and B together are a cross-sectional view taken along the line 2—2 in FIG. 1.
Figure 2B:
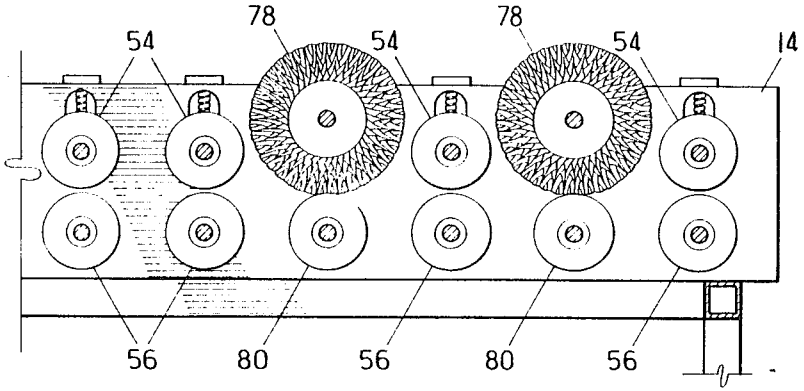

Shown in FIG. 1, and generally designated at 10, is a paint stripper apparatus constructed in accordance with the present invention. The paint stripper apparatus 10, also shown in detail in FIGS. 2 and 3, is mounted on a rectangular metallic frame 12 intended to be free standing upon a floor surface. Mounted upon the frame 12 are a pair of vertically upstanding side plates 14 and 16 which extend the length of the paint stripping apparatus 10. The side plates 14 and 16 define between them a passage through which objects will be passed for paint stripping, extending from a feed end designated at 18 to an exit end designated at 20.

In between the feed end 18 and the exit end 20, at an intermediate point in the apparatus is an impact assembly, generally indicated at 22. On the lower sides of the impact assembly are respective side mounting bars 24, one attached respectively to each of the side plates 14 and 16. Only a one of the side mounting bars 24 can be viewed in FIG. 1, but the one on the opposite side attached to the side plate 14 is identical to that illustrated in FIG. 1. The side bars 24 are firmly secured to the respective side bar 14 or 16 by fastener attachment or by welding. Extending through the side bars 24 are a pair of vertical adjustment bolts 26. The vertical adjustment bolts 26 extend vertically, are threaded into suitable holes provided in the side mounting bars 24, and are secured at their lower ends to a floating support bed 28. The floating support bed 28 extends completely transversely across and under the pair of side plates 14 and 16, underneath the entire impact assembly 22. As can be better viewed in FIG. 2, upstanding supports 30 extend vertically upward from the floating support bed 28 to support a horizontal platen support plate 32. The platen support plate 32 is a rectangular sheet of rigid material, such as sheet steel, rigidly fixed by the upstanding supports 30 to the floating support bed 28. On top of the platen support plate is a damper 34 of compressible resilient material, such as a foamed thermoplastic resin. On top of the damper 34 is mounted a platen 36. The platen 36 extends forwardly and rearwardly of the damper 34 and platen support plate 32, and has canted forward and rearward ends, so that an article approaching the platen 36 from either end tends to be directed upward to ride across the top surface of the platen. The platen 36 itself is of rigid sheet steel or other very rigid, hard and durable material.

Mounted on each of the side plates 14 and 16, above the side mounting bars 24, are pairs of chisel mounting bars 38. There is a pair of the chisel mounting bars 38 on each of the side bars 14 and 16, and the chisel mounting bars 38 are firmly fixed, by fasteners or by welding, to the respective side plate 14 or 16. Associated with a parallel pair of the chisel mounting bars 38, one on each of the side plates 14 and 16, is one of a pair of common chisel support plates 40. Each of the chisel support plates 40 extends transversely across the top of the side plates 14 and 16 to extend over respective chisel mounting bars 38 on each of the side plates. Each rectangular chisel support plate 40 is fastened, adjacent each of its four corners, to one of a set of tension springs 42 each of which is connected at its other end to an end of one of the chisel mounting bars 38. On each side of each chisel support plate 40, located between a pair of the tension springs 42, is a suspension connection 44 extending between the chisel support plate 40 and the respective chisel mounting bar 38. The suspension connection 44 includes a rod threaded through the chisel support plate 40 which abuts but is not fixed to a point upstanding from the side mounting bar 38. The length of suspension connection 44 is adjustable, by threading the rod through the chisel support plate 40, so as to vary the minimum distance between the chisel support plate 40 and the chisel mounting bar 38 on each side of the chisel support plate 40. The suspension connection 44 is thus connected such that the connection can be stretched or extended, but will not allow the distance between the chisel support plate 40 and the chisel mounting bar 38 to fall beneath a preset minimum.

As can be seen in FIG. 2, the chisel support plate 40 includes a secondary chisel support plate 46 located underneath it. A series of pneumatically driven needle chisels 48 are mounted in the chisel support plates 40 and 46. The needle chisels 48 are commercially available, pneumatically driven, chisels which have a plurality of reciprocating needles which rapidly and forcefully reciprocate under air pressure. The needle chisels 48 can be hand held for use in hand scaling articles. Suitable needle chisel assemblies are produced by Nitto Kohki Co., Ltd. of Tokyo, Japan and marketed under the name Jet Chisel. Such chisels are driven under pneumatic pressure with a reciprocation rate of between 4,000 and 4,500 reciprocations per minute. The needle stroke is approximately 14 millimeters. There are seven of the needle chisels 48 mounted on each of the chisel support plates 40 and the needle chisels 48 are arranged so that all parts of an article conveyed under a chisel support plate 40 are contacted by the needles of a needle chisel 48. Since there are two assemblies of needle chisels 48 and support plates 40, all parts of an article will be contacted at least twice by the needle chisels. The needle chisels 48 are not mounted directly vertically in each assembly, as can be viewed in FIG. 2, but are located at a slightly obtuse angle relative to the direction of motion of articles through the apparatus, with the bottom of each of the chisels being displaced slightly toward the rear of the stripper assembly 10. A series of passive rollers 50 are also located in the area of the chisel assembly spaced above the platen 36, as can be viewed in FIG. 2.

Located between the impact assembly 22 and the feed end 18 of the apparatus 10 are a series of identical pairs of self-adjusting driven rollers 52. In the embodiment illustrated in FIGS. 1 and 2, there are five of the roller pairs 52 located in front of the impact assembly 22 and an additional five pairs of self-adjusting driven rollers 52 located toward the exit end of the apparatus 10 from the impact assembly 22. Each of the self-adjusting driven rollers 52 includes an upper roller 54 and a lower roller 56, both of which are cylindrical, coated rollers. Each of the upper and lower rollers 54 and 56 are rotationally mounted on axles which extend through appropriate openings formed in each of the side plates 14 and 16 located at opposite ends of each of the rollers. The axles of the upper rollers 54 are received in blocks 58, which are mounted so that they are free to travel in vertical chanels 60 cut into the side of each of the side plates 14 and 16. At the top of each of the side plates 14 and 16, and above the axle of each end of each of the upper rollers 54, are a series of retaining tabs 62 which are welded to the tops of the respective side plates 14 and 16 so as to be fixedly secured thereto. Between the retaining tabs 62 and the blocks 58, for each end of each of the upper rollers 52, is a compression spring 64 which is compressed between the retaining tab 62 and the respective block 58 to generally resiliently urge the block 58 downwardly.

The lower rollers 56 also have axles which extend outwardly through each of the respective side plates 14 and 16. The axles of the lower rollers 56 extend some distance out through the side plate 16 (as shown in FIG. 1) and have mounted on them, outside of the side plate 16, cylindrical drive gears 66. The drive gears 66 are fixed to the axles of the lower rollers 56 so that rotation of the drive gears 66 rotates the lower rollers 56. The drive gears 66 are all interconnected by a series of drive chains 68 so that rotation of one drive gear 66 causes rotation of all the other drive gears 66. The drive chains 68 are preferably link chains, which are entrained upon cogs provided on the drive gears 66, but also could be tensioned belts or toothed belts coacting with cooperatively formed surfaces on the drive gears 66. A main drive chain 70 connects a one of the drive gears 66 with an electric drive motor 72 located on an undercarriage formed on the metallic frame 12.

Also located on the undercarriage formed on the frame 12 is a compressed air reservoir 69 connected by suitable pneumatic tubing 67 to provide pneumatic force for driving the needle chisels 48.

Also mounted on the undercarriage of the frame 12 is a second electric drive motor 73 which drives a connecting belt 74 entrained upon a wheel 76 located outside of the side frame 16 toward the exit end 20 of the assembly 10. The connecting belt 74 is preferably a toothed belt coacting with cooperatively shaped toothed surfaces on the axle of the electric motor 73 and on the wheel 76 so that rotation of the motor 73 is conveyed to the wheel 76. The wheel 76 is connected through the side frame 16 to one of a pair of brush-polishers 78. The brush-polishers 78 are mechanically interconnected so that rotation supplied to one of the brush-polishers 78 also rotates the other through a connecting mechanism on the hidden side of the side plate 14 as viewed in FIG. 1. The brush-polishers 78 are wheels carrying thereon stiff wire-like bristles, so that rotation of the brush-polisher 78 causes a continuous abrasive polishing of an article placed at the periphery of the rotation. Mounting blocks are provided (not shown) for the brush-polishers 78 so that they may be vertically adjusted in their position to provide desired contact with material passing underneath. As can be viewed in FIG. 2B, passive rollers 80 are provided underneath each of the brush-polishers 78 and physically arranged so that material passing between the respective brush-polishers 78 and the wheel 80 is properly contacted by the brush-polisher 78.

In its method of operation, the paint stripping assembly 10 of FIGS. 1 and 2 is intended to be used in conjunction with a cryogenic cooling tank to easily and efficiently remove paint from hangers, or other devices, which are repetitively paintcoated in a factory which routinely paints lines of articles. The apparatus 10 is particularly adapted for easily removing paint from materials, such as hangers, which have been previously subject to cryogenic cooling.

Therefore, the method of using the assembly 10 of FIGS. 1 and 2 to remove paint begins with taking the article from which paint is to be removed, such as an elongated hanger with a series of hooks thereon, and subject it to cryogenic cooling. The preferred method for doing this is to submerse the hanger itself in a bath of liquid, such as liquid nitrogen, maintained at cryogenic temperatures. This is done prior to insertion of the hanger into the paint stripping apparatus 10 of FIGS. 1–2. Unlike many of the practices previously associated with paint stripping in the prior art, however, it is not necessary that the hangers, or other articles from which paint is to be removed, be maintained at cryogenic temperatures throughout the paint stripping apparatus. In fact, if a batch of hangers or other articles is to be stripped, the entire batch of articles can first be subjected to cryogenic cooling by dipping the articles, one at a time, into the cryogenic temperature and then storing all the articles so dipped at room temperatures until such time as they can be conveyed to the paint stripper apparatus 10. The apparatus 10 will still be successful in removing the paint therefrom. This therefore makes the apparatus much easier to utilize since the whole apparatus does not have to be maintained in cryogenic temperatures.

Once the hangers or other articles are conveyed to the paint stripping apparatus 10, the electric motors 72 and 73 are actuated and compressed air is provided to the air reservoir 69. The motor 72 causes drive to be provided through the main connecting chain 70 to drive all of the drive gears 66 on the lower rollers 56 throughout the apparatus 10. Therefore all of the lower rollers 56 are in motion, in a clockwise direction as viewed in FIG. 2, so as to convey an article through the apparatus 10 from the feed end 18 to the exit end 20. A hanger, indicated at H in FIG. 2, can then be inserted into the opening at the feed end 18 between the upper and lower rollers 54 and 56 at the feed end. The motion of the lower rollers 56 thereafter conveys the hanger into the apparatus 10 so that it is drawn linearly between each of the pairs of upper and lower rollers 54 and 56, as is illustrated by the hanger H shown in FIGS. 1 and 2. Each of the upper rollers 54 is pressed upward against its compression springs 64 as the hanger H passes underneath it, with the compression springs 64 urging the roller 54 downward to pin the hanger H against the adjacent lower roller 56.

As the hanger H is drawn between the pairs of upper and lower rollers 54 and 56 into the impact assembly 22, it is received upon the platen 36. It is for this reason that the forward end of the platen 36 is canted downwardly so as to ensure that the hanger H is received upon the top of the platen 36 in a proper fashion. The hanger H rides underneath the passive rollers 50 and is pinned by them against the platen 36. The passive rollers 50 thus prevent recoil of the hanger H off the platen 36.

As the hanger H passes through the impact assembly 22, it is subjected to rapid and forceful impact from the needle chisels 48 which are pneumatically driven by the air provided from the air reservoir 69. The reciprocating needles contained in the needle chisels 48 individually knock pieces of paint off of the hanger H and effectively, efficiently, and quickly remove all of the paint from the surface of the hanger H exposed to the needle chisels 48. As can be seen in FIG. 2, the pairs of assemblies of needle chisels 48 are provided to sequentially contact each part of each of the hangers H at least twice so as to assure that all paint is removed therefrom. The obtuse angle between the direction of movement of the hanger H and the axes of the needle chisels 48 ensures efficient operation of the needle chisels 48. If the needle chisels 48 were simply vertical, they would tend to impede motion of the hanger H through the apparatus 10 and would also tend to have their ends broken off by the impact and by the motion of the hanger. The angling of the needle chisels 48 helps, rather than impedes, the movement of the hanger, and avoids a high rate of needle breakage.

After leaving the impact assembly 22, the hangers are conveyed underneath each of the two brush-polishers 78. The brush-polishers 78 are being actively rotated by the force provided from the motor 73. The wire bristles contained in the brush-polishers 78 abrade the surface of the hanger H as it passes between the respective brush-polishers 78 and the roller 80 provided underneath it, so as to rapidly polish the surface of the hanger H. This polishing action is provided only on one side of the hanger H, which is the side exposed upwardly as viewed in FIG. 2.

The hanger is then conveyed out of the exit end 20 of the apparatus. Since only one side of the hanger has been stripped during one pass through the assembly 10, it is then necessary to turn over the hanger H or other article and insert it again at the feed end 18 of the apparatus so that it may be drawn through the apparatus 10 again to strip the paint from the opposite side thereof.

The paint stripper apparatus 10 of the present invention offers several significant advantages over prior art devices. One advantage is that the hangers or other articles from which paint is to be stripped do not need to be kept cryogenically cooled while the stripping activity occurs. While cryogenic cooling of the article does faciliate paint removal, the cryogenic cooling can be made at a time different from the time in which the articles are fed through the apparatus 10. The provision for the needle chisels 48 assures rapid efficient and thorough removal of all paint from the articles in an efficient and quick fashion.

The provision for the brush-polisher 78 in the apparatus 10 of the present invention also offers several significant advantages over prior art designs. Not only do the brush-polisher 78 ensure that all final particles of paint are removed from the hanger or other article, it also abraids and polishes the surface of the article so that it has a shinny matte appearance when removed from the paint stripper. Not only does this give the stripped article more pleasing in appearance, it also smooths the surface of the article so that the next time the article is painted, paint will not adhere as well to the surface of the article. In other words, for articles which must be repetitively stripped of their paint, such as hangers used in a factory painting system, the provision of the brush-polisher 78 not only facilitates the stripping of paint during the first use of the apparatus 10 on the given hanger, but also facilitates and eases the later removal of subsequent coatings of paint from the same hanger.

It is to be understood that the present invention is not limited to the particular illustrations and embodiments disclosed herein, but encompasses all such modified forms thereof as come within the scope of the following claims:

I claim:

1. Apparatus for stripping paint from articles comprising, in combination:

(a) an elongated frame (12), (b) means (56) for supporting and conveying a plurality of articles (H) longitudinally along said frame in an upstream-to-downstream direction, (c) impacting means (48) for repetitively impacting the articles to remove paint therefrom, (d) and means (78) disposed downstream of said impacting means:

(1) for removing any remaining paint particles on the moving articles, (2) and for smoothing the article surfaces to a shiny matte appearance so that subsequently applied paint is less adherent.

2. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) means (26, 28, 30) adjustably mounting said platen (32) to said frame, (f) damper means (34) supporting said platen, (g) and downwardly canted end means on said platen to cause an article approaching the latter to ride up thereonto.

3. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) a floating support bed (28) for said platen (32) and with said bed having a plurality of corners, (f) and independent vertical adjustment means (42) disposed between said bed corners and said frame.

4. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) and means (40, 46) mounting said needle chisels (48) at an oblique angle pointed in said downstream direction so that said chisels, upon contact with said articles, assist in said upstream-to-downstream movement thereof, (f) said mounting means comprising a pair of vertically spaced plates (40, 46) through which said needle chisels (48) pass.

5. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) and means (78) disposed downstream of said platen (32):

(1) for removing any remaining paint particles on the moving articles, (2) and for smoothing the article surfaces to a shiny matte appearance so that subsequently applied paint is less adherent.

6. The pain stripping apparatus of claims 2, 3 or 5 which includes means (40, 46) mounting said needle chisels (48) at an oblique angle pointed in said downstream direction so that said chisels, upon contact with said articles, assist in said upstream-to-downstream movement thereof.

7. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) means (40, 46) mounting said needle chisels (48) to said frame, (f) and torsion springs (42) associated with said mounting means and responsive to impact of said needle chisels on the moving articles to cause recoil of said mounting means, (g) said mounting means comprising a pair of vertically spaced plates (40, 46) through which said needle chisels (48) pass.

8. Apparatus for stripping paint from articles comprising, in combination:

(a) an elongated frame (12), (b) means (56) for supporting and conveying a plurality of articles (H) longitudinally along said frame in an upstream-to-downstream direction, (c) a horizontal platen (32) mounted to said frame and disposed so that conveyed articles pass thereover and are supported thereby, (d) a plurality of reciprocating needle chisels (48) disposed above said platen for striking articles as they pass over said platen to thereby remove paint therefrom, (e) means (40, 46) mounting said needle chisels (48) to said frame, (f) torsion springs (42) associated with said mounting means and responsive to impact of said needle chisels on the moving articles to cause recoil of said mounting means, (g) and means (78) disposed downstream of said platen (32):

(1) for removing any remaining paint particles on the moving articles, (2) and for smoothing the article surfaces to a shiny matte appearance so that subsequently applied paint is less adherent.

9. The paint stripping apparatus of claim 5 or 8 which includes: means (80) for holding the moving articles against said last-named means (78).

10. The paint stripping apparatus of claim 6 which includes: means (80) for holding the moving articles against said last-named means (78).

* * * * *